US007325969B2

(12) United States Patent
Kretzschmar et al.

(10) Patent No.: US 7,325,969 B2
(45) Date of Patent: Feb. 5, 2008

(54) CONTAINER MIXER

(75) Inventors: Ralf Kretzschmar, Dresden (DE); Heinz Pritzke, Kesselsdorf Ot Braunsdorf (DE); Christian Schwaar, Bannewitz (DE)

(73) Assignee: Glatt Systemtechnik GmbH, Dresden (DE)

( * ) Notice: Subject to any disclaimer, the term of this patent is extended or adjusted under 35 U.S.C. 154(b) by 72 days.

(21) Appl. No.: 10/885,733

(22) Filed: Jul. 8, 2004

(65) Prior Publication Data

US 2006/0007780 A1 Jan. 12, 2006

(51) Int. Cl.
*B01F 9/00* (2006.01)

(52) U.S. Cl. ..... 366/217; 366/232

(58) Field of Classification Search ..... 366/197–236
See application file for complete search history.

(56) References Cited

U.S. PATENT DOCUMENTS

| | | | | | |
|---|---|---|---|---|---|
| 1,292,127 | A * | 1/1919 | Stevens | 366/217 |
| 1,755,763 | A * | 4/1930 | Barber | 134/150 |
| 2,652,983 | A * | 9/1953 | Hall | 241/98 |
| 3,174,728 | A * | 3/1965 | Mack | 366/213 |
| 3,421,053 | A * | 1/1969 | Watson et al. | 361/149 |
| 3,706,443 | A * | 12/1972 | Oberhauser | 366/216 |
| 4,004,783 | A * | 1/1977 | Wilson | 366/200 |
| 4,077,613 | A * | 3/1978 | Wilson | 366/213 |
| 4,100,616 | A * | 7/1978 | Wilson | 366/213 |
| 4,135,828 | A * | 1/1979 | Cabak | 366/197 |
| 4,146,335 | A * | 3/1979 | Hutchings et al. | 366/217 |
| 4,372,686 | A * | 2/1983 | Herfeld | 366/220 |
| 4,468,129 | A * | 8/1984 | McIntosh et al. | 366/213 |
| 4,671,666 | A * | 6/1987 | Herfeld | 366/197 |
| 4,676,658 | A * | 6/1987 | Herfeld | 366/197 |
| 4,775,242 | A * | 10/1988 | Bohle | 366/209 |
| 4,957,373 | A * | 9/1990 | Derksen et al. | 366/197 |
| 5,054,933 | A * | 10/1991 | Derksen et al. | 366/138 |
| 5,107,878 | A * | 4/1992 | Young | 134/153 |
| 5,123,747 | A * | 6/1992 | Derksen | 366/197 |
| 5,344,275 | A * | 9/1994 | Habicht | 414/420 |
| 5,516,207 | A * | 5/1996 | Haicht | 366/213 |
| 5,865,538 | A * | 2/1999 | Walker et al. | 366/197 |
| 6,062,724 | A * | 5/2000 | Habicht | 366/209 |
| 6,241,380 | B1 * | 6/2001 | Bornemann et al. | 366/217 |
| 6,390,663 | B1 * | 5/2002 | Civardi | 366/217 |
| 6,520,673 | B2 * | 2/2003 | Marple et al. | 366/213 |
| 2006/0007780 | A1 * | 1/2006 | Kretzschmar et al. | 366/217 |

FOREIGN PATENT DOCUMENTS

| | | | |
|---|---|---|---|
| DE | 94 00 396.3 | | 5/1994 |
| JP | 1-127030 | | 5/1989 |
| JP | 11-33380 | * | 2/1999 |
| WO | 90/02002 | * | 3/1990 |

* cited by examiner

*Primary Examiner*—Charles E. Cooley
(74) *Attorney, Agent, or Firm*—Jacobson Holman PLLC

(57) ABSTRACT

A container mixer comprising a loadbearing device, a mixer arm (5) and a docking unit (6) for holding a container (7). The mixer arm (5) is mounted on the rotatable part of a first rotary device (10) having a horizontal first axis of rotation (14), whose fixed part is held on a loadbearing device, and the docking unit (6) is mounted on the rotatable part of a second rotary device (11) having a second axis of rotation (15), whose fixed part is held on the mixer arm (5). The fixed part of the first rotary device (10) can also be mounted on a lifting carriage (4) which is vertically displaceably mounted on the loadbearing device. The axes of rotation of the first and second rotary device (10, 11) can be arranged in such a way that their axes of rotation (14, 15) intersect within the container (7).

4 Claims, 1 Drawing Sheet

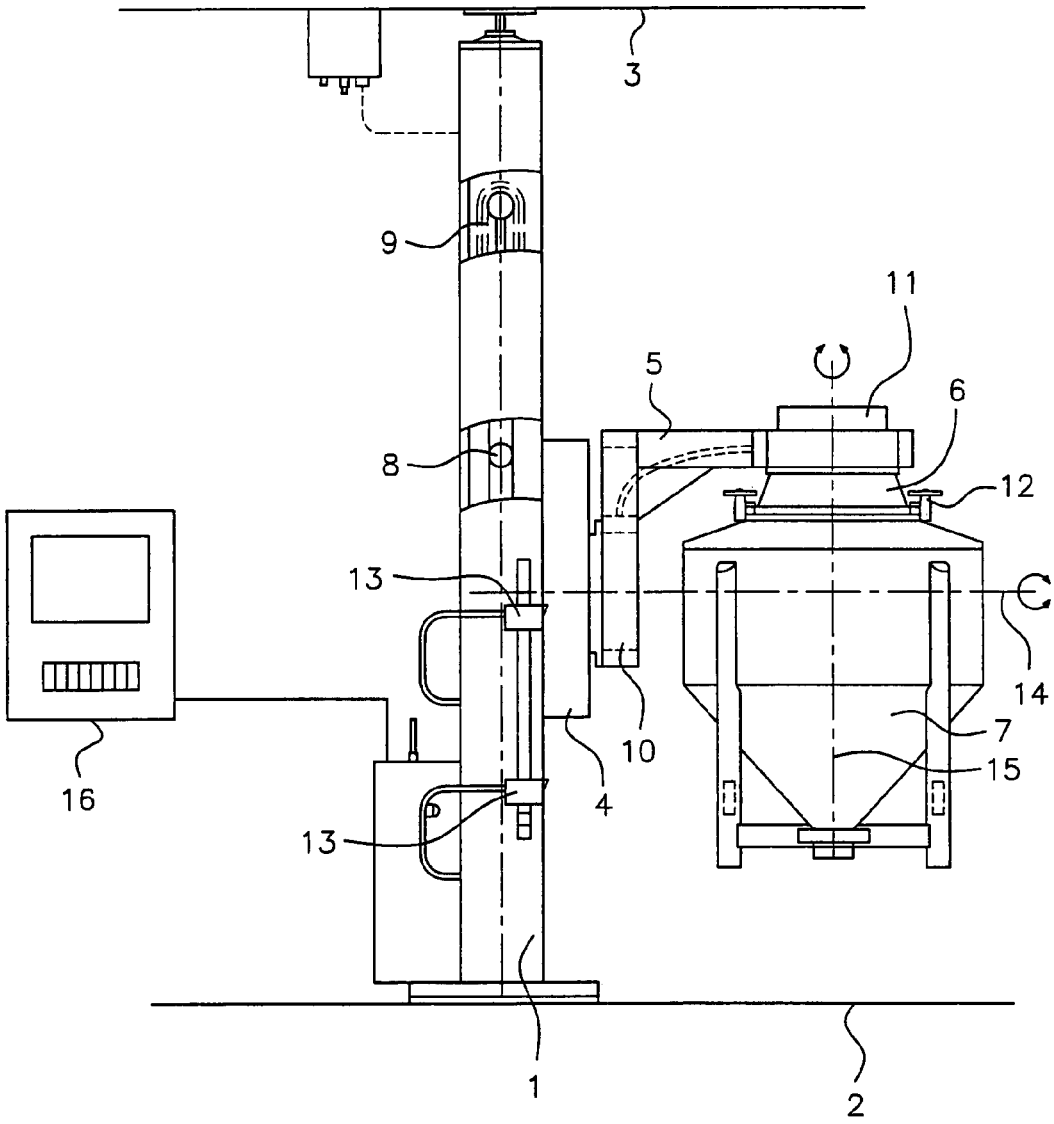
3
9
11
5
6
8
12
13
14
10
7
15
16
4
13
1
2

CONTAINER MIXER

TECHNICAL FIELD

The invention relates to a container mixer for mixing at least two components as material to be mixed by circulating the components within a container.

PRIOR ART

For the careful mixing of at least two components as material to be mixed, according to the prior art various systems are known in which the material to be mixed is circulated within a moving container, without there being separate mixer elements.

JP 01127030A specifies a container of rotating type mixing apparatus. The container is pivotably mounted on a horizontal crossmember and its axis is inclined with respect to a vertical axis of rotation, the vertical axis of rotation and the axis of the container intersecting at the centre of the container. The lower end of the container is connected to a drive of the vertical axis of rotation via an eccentric lever.

DE 94 00 396 U1 specifies a container mixer which has a container holding device which is connected to a mixing drive, with which the container can be rotated about a horizontal axis. The container mixer can have a lifting carriage that can be adjusted vertically on a lifting column. The container is held on the mixing drive by means of loadbearing arms which are rigid and connected to each other, and closure arms, pivotably connected to these, in order to reach around the angular container.

The disadvantage of the prior art is that the material to be mixed is mixed substantially relatively well radially with respect to the axis of rotation but only relatively poorly in the line parallel to the axis of rotation.

DESCRIPTION OF THE INVENTION

The invention is therefore based on the object of specifying a container mixer of the type mentioned at the beginning with which fast and good thorough mixing of the material to be mixed is possible.

The container mixer substantially comprises a mixer arm, which is mounted on a loadbearing device and on which there is a docking unit, on which a container can be held. In this case, the mixer arm is mounted on the loadbearing device such that it can rotate about a horizontal first axis of rotation, and the docking unit is mounted on the mixer arm such it can rotate about a second axis of rotation. The two axes of rotation advantageously intersect within the docked container.

The rotatable mountings can be implemented in practice in various ways by means of electric, pneumatic or hydraulic drives. Rotary devices with spherical rotary connections and external toothing, which are driven via pinions by a hydraulic motor with a disk brake, have proven to be advantageous.

A first rotary device having the first horizontal axis of rotation is located within the mounting of the mixer arm on the loadbearing device. A second rotary device having the second axis of rotation is provided within the mounting of a docking unit for holding the container on the mixer arm. By means of the second rotary device, the container can be rotated about its own axis and, by means of the first rotary device, can be rotated about a horizontal axis together with the mixer arm.

In practice, it has proven to be advantageous if the mounting of the mixer arm on the loadbearing device is designed to be vertically adjustable. For this purpose, a lifting carriage can be provided, which is vertically adjustably mounted on the loadbearing device and on which the mixer arm is mounted. The loadbearing device can, for example, be mounted rigidly on a wall or can be arranged as a free-standing loadbearing column within a room. In this case, the loadbearing column can advantageously also be designed to be pivotable, which means that the mixer arm with the docking unit can also be pivoted in a circular region in relation to the container.

DETAILED DESCRIPTION OF THE INVENTION

The invention is to be explained in more detail below using an exemplary embodiment.

The drawing shows a container mixer for mixing pharmaceutical components with a powdery or granular structure. The containers are matched to the given process conditions of a pharmaceutical company. The containers have a cylindrical form and a holding capacity of between 500 and 1500 liters.

The container mixer substantially comprises a loadbearing column 1, which is mounted stably and pivotably between the floor 2 and the ceiling 3 of a working room, a lifting carriage 4 that is vertically displaceable on the loadbearing column 1 and also a mixer arm 5 having a docking unit 6, on which the respective container 7 can be docked.

The loadbearing column 1 comprises a torsionally rigid profile, in which horizontal and vertical guide rollers 8 mounted on the lifting carriage 4 run. In order to set the necessary vertical position of the lifting carriage 4, on the loadbearing column 1 there is a hydraulically driven lifting device 9, which has a lifting chain which is held firmly on one side, is led over a deflection roller and acts with the other end on the lifting carriage 4. Therefore, the lifting travel of the lifting carriage 4 is doubled with respect to the lifting travel of the hydraulic cylinder of the lifting device. In the standard positions of the lifting carriage 4, for docking the container 7 and for mixing, there are locking devices 13 on the loadbearing column 1, with which the lifting carriage 4 can be locked with respect to the loadbearing column 1.

Screwed directly to the lifting carriage 4 is a baseplate, which carries a first rotary device 10 in the form of a spherical rotary joint with external toothing. This spherical rotary joint is driven via a pinion by a hydraulic motor with disk brake. The mixer arm 5 is mounted on the rotating part of the first rotary device 10. A mechanical lock which can be pivoted in on the lifting carriage 4 permits the mixer arm 5 to be locked in a vertical position of the container for the purpose of docking and at the end of the mixing operation. The mixer arm 5 is formed as an angle, the vertical mounting on the lifting carriage 4 being carried out on one leg via the first rotary device 10 and, on the other leg, the docking unit 6 being mounted via an equivalent second rotary device 11. The axis of rotation 14 of the first rotary device 10 and the axis of rotation 15 of the second rotary device 11 are aligned at right angles to each other and intersect within the container. In this case, the point of intersection of the two axes of rotation should lie approximately at the centre of mass of the mixer arm 5 and of the docked container 7 filled with material to be mixed.

The docking unit 6 is screwed to the rotating part of the second rotary device 11. It carries four suspension devices 12, into which matching holding elements of the container 7 are hooked. The suspension devices 12 and the holding elements can be screwed to one another, so that a fixed mounting of the container 7 on the mixer arm 5 is ensured for mixing.

In the following text, the function of the device is to be described in more detail.

A container 7 has been filled outside the device with various powdered components which are to be mixed homogeneously with one another, and closed. The container 7 is brought into a position on the radius of the axis of rotation 15 in relation to the loadbearing column 1. In parallel with this, further containers can be brought into a corresponding, differing position. The loadbearing column 1 with the mixer arm 5 and the docking unit 6 is then pivoted over the container 7 and the suspension devices 12 are screwed to the container 7 with the holding elements.

Then, via an electric control system 16, a predefined mixing program is entered, which depends on the mixing conditions necessitated technologically for the actual material to be mixed. In this case, the rotational speeds of the first rotary device 10 and also of the second rotary device 11, the ratio of the two rotational speeds to each other, the direction of rotation of the two rotary devices 10 and 11 and also the mixing time can be set individually.

The lifting carriage 4 with the mixer arm 5 and the container 7 is raised into the mixing position, locked there with respect to the loadbearing column 1 by the appropriate locking device 13, and the predefined rotation of the container 7 about the first axis of rotation 14 and the second axis of rotation 15 is started. In the process, the material to be mixed is mixed very intensively in a short time by the superimposed movements. After the predefined mixing time has elapsed, the rotation is ended, the rotary devices 10 being stopped and secured by the pivotable mechanical lock on the lifting carriage 4 in such a way that the axis of rotation 15 is vertical and the container 7 can be detached from the docking unit.

What is claimed is:

1. A container mixer comprising a loadbearing device, a lifting carriage vertically and linearly displaceably mounted on said loadbearing device, a first rotary drive device mounted on said lifting carriage, said first rotary device having a fixed part and a rotatable part with the rotatable part having a horizontal first axis of rotation, a mixer arm non-rotatably fixed to said rotatable part of said first rotary device at a location offset from said first axis of rotation, a second rotary drive device mounted on said mixer arm, said second rotary drive device being driven independently of said first rotary drive device, said second rotary drive device having a fixed part and a rotatable part with the rotatable part having a second vertical axis of rotation, a docking unit for holding a container, said docking unit being mounted on said rotatable part of said second rotary device, said fixed part of said first rotary drive device being mounted on said lifting carriage and said fixed part of said second rotary drive device being mounted on said mixer arm, said first horizontal axis of rotation of said first rotary device and said second vertical axis of rotation of said second rotary device intersect at a point within the container held by said docking unit for mixing material in the container both radially and parallel to said second vertical axis of rotation.

2. The container mixer as claimed in claim 1, wherein said first and second rotary devices have an electric or elctro-hydraulic drive.

3. The container mixer as claimed in claim 1, wherein said docking unit has suspension devices for engaging holding elements on the container and for holding the container on said docking unit and on said mixer arm.

4. The container mixer as claimed in claim 1, wherein said loadbearing device is a pivotable loadbearing column.

* * * * *